United States Patent [19]

Hofmann

[11] 4,401,265

[45] Aug. 30, 1983

[54] METHOD AND DEVICES FOR MAKING TRAFFIC LINES OR THE LIKE

[75] Inventor: Frank Hofmann, Hamburg, Fed. Rep. of Germany

[73] Assignee: Firma Walter Hofmann, Rellingen, Fed. Rep. of Germany

[21] Appl. No.: 195,724

[22] Filed: Oct. 10, 1980

[30] Foreign Application Priority Data

Oct. 13, 1979 [DE] Fed. Rep. of Germany ..... 2941602

[51] Int. Cl.[3] ..... E01F 9/08; E01C 23/16

[52] U.S. Cl. ..... 239/1; 239/172; 239/185; 427/137

[58] Field of Search ..... 239/150, 172, 178, 184–186, 239/1; 118/305, 323; 427/137; 198/748, 750; 187/12

[56] References Cited

U.S. PATENT DOCUMENTS

| | | | |
|---|---|---|---|
| 2,026,678 | 1/1936 | Hefner | 239/186 X |
| 2,974,875 | 3/1961 | Brown | 239/150 |
| 3,421,476 | 1/1969 | Mattas | 118/305 X |
| 4,011,833 | 3/1977 | Hawkins | 118/323 |
| 4,151,905 | 5/1979 | Takahashi | 187/12 X |

*Primary Examiner*—Andres Kashnikow

*Attorney, Agent, or Firm*—Allison C. Collard; Thomas M. Galgano

[57] ABSTRACT

In a method for making marking strips and marking interruptions like broken traffic lines on roads etc., the application of the marker strips and the running past the marker interruptions are carried out at different speeds, whereby the speed during application of the marking strip on the ground is reduced with respect to the speed during the subsequent marking interruptions. Devices for carrying out the method are also disclosed.

1 Claim, 2 Drawing Figures

METHOD AND DEVICES FOR MAKING TRAFFIC LINES OR THE LIKE

Figure 1:
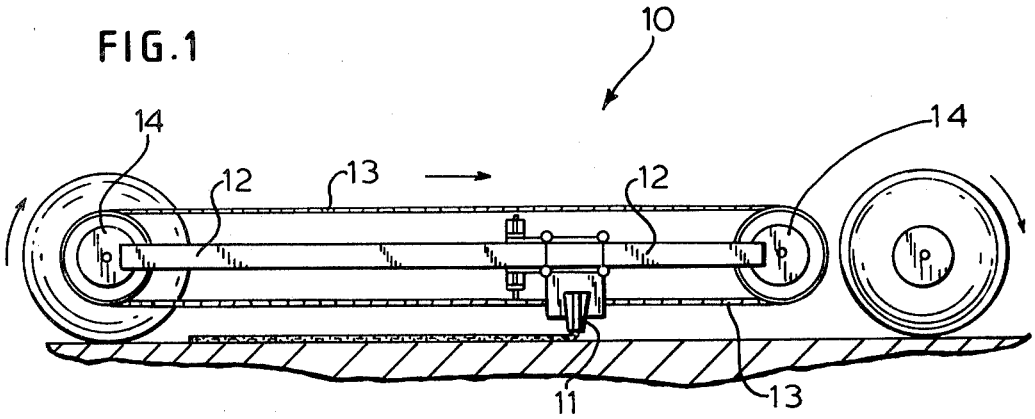

The invention relates to a method for making traffic marking strips and interruptions in these strips, like traffic lines on roads, or the like, as well as devices for carrying out the method.

When making interrupted or broken traffic lines with generally known marking machines, the maximum operating speed is determined by the maximum obtainable speed of the actual marking device which applies the marking material (for example, a paint spray gun) depending on the desired quality of the guide line to be made.

Although the road marking machine could proceed at a higher speed while making the interruption or gap between the line segments, the speed with which the marking material is applied during making of the line must be maintained. This is particularly uneconomical when the lengths of the strip interruptions or gaps are very large in contrast to the actual applied lines, because of the relatively slow speed required by the application device.

These disadvantages are eliminated with the subject invention which increases the operating speed of the marking machine considerably when making broken traffic lines, thereby increasing the daily output without exceeding the permissible speed for the application device for obtaining a good marking quality for the traffic line.

This object of the invention is obtained in accordance with the inventive method, by carrying out the application of the marking strips and the running through of the marking interruption at different speeds, whereby the speed during application of the marking strip on the ground is reduced with respect to the speed during the subsequent marking interruptions.

A device for carrying out the method may consist, for example, of a movable marking machine preferably having a hydraulic drive coupled with an application device which is stationarily mounted on the machine. The machine would be provided with control means for different drive speeds of the marking machine during the marking operation and the marking interruption operation.

In a preferred embodiment of the device for carrying out the inventive method, the application device is moveably disposed in and against the moving direction of the movable marking machine. During the marking of a traffic line, the application device moves from a forward position, in a defined adjustable relative speed, to a rearward position.

During the marking of a traffic line segment, the application device should move with a defined adjustable relative speed from a forward position of the marking machine to a rearward position. By the amount of this relative speed, the moving speed of the marking machine may be increased to the highest possible speed of the application device which would be permissible for a good traffic line quality. For example, if the highest permissible speed of the application device with respect to the road surface is 5 km/h, the technical design for the street marking machine would permit a relative speed of 3 km/h of the application device, opposite to the driving direction. Therefore, the moving speed of the marking machine may be increased by $5+3=8$ km/h without exceeding the highest permissible speed of the application device of 5 km/h. During the traffic line interruptions or gaps, the device which applies the marking material moves again to the front and therefore to its initial position.

It has been shown to be extremely advantageous to couple the displacement mechanism for the application device with the chassis of the marking machine, so as to provide a well defined arrangement. If need be, a transmission gear may be disposed between the displacement mechanism and the chassis.

For carrying out the displacement movement of the application device on the marking machine, a guide rail may be mounted on the marking machine on which the application device is slidably mounted. The application device is movable by means of a chain which runs parallel to the guide rail and to which it is releasably coupled, so that the application device may be displaceably moved by and alternately coupled to the forward or rearward running strand of the chain.

Other objects and features of the present invention will become apparent from the following detailed description when taken in connection with the accompanying drawing which discloses one embodiment of the invention. It is to be understood that the drawing is designed for the purpose of illustration only and is not intended as a definition of the limits of the invention.

Figure 2:
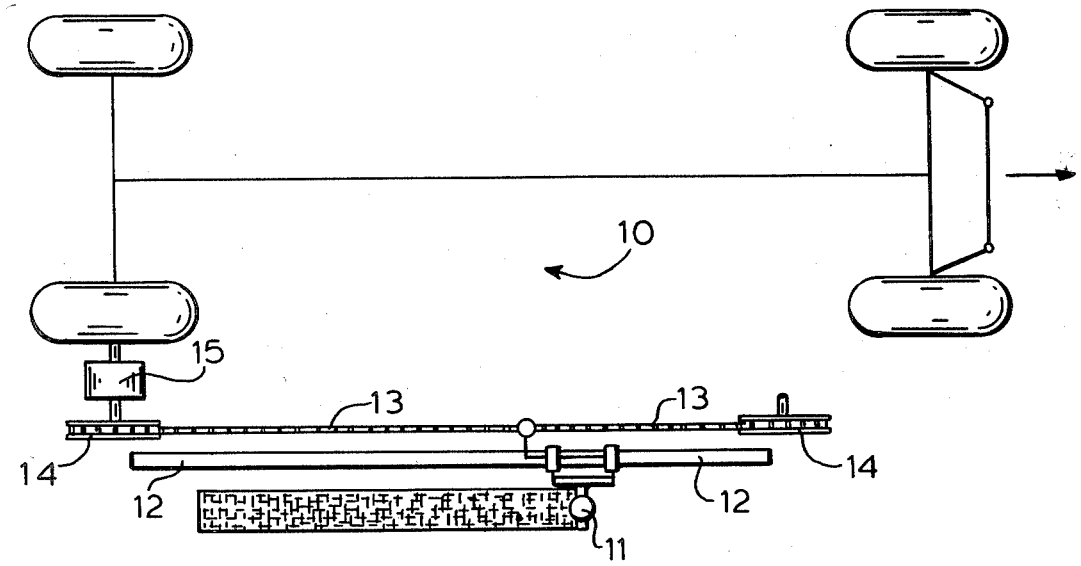

In the drawing, wherein similar reference characters denote similar elements throughout the several views:

FIG. 1 is a schematic side view of a marking machine embodying the present invention; and FIG. 2 is a schematic plan view thereof.

As can be seen from FIGS. 1 and 2, a guide rail 12 is mounted on the side of a marking machine 10. An application device 11 is displaceably mounted on guide rail 12. An endless chain 13 runs parallel to guide rail 12 and is guided over sprockets 14 disposed adjacent to opposite ends of guide rail 12. One of the sprockets is driven by the chassis of the marking machine, i.e., by one of the wheels of the marking machine, so as to achieve a relatively proportional running speed of the chain equal to that of the machine. In order to make the relative chain speed adjustable to the machine speed, a drive 15 having an adjustable transmission ratio may be mounted between the wheel axle of the machine and the drive sprocket for the chain.

When the machine moves and when the application device 11, which is in its forward position (its initial position), reaches the point on the road at which the application for the traffic line should start, the application device is actuated by means of a conventional pneumatic, electric or hydraulic mechanism and the former is simultaneously coupled with the lower strand or run of chain 13. At this point, the application device slides slowly rearwardly along the machine whereby its forward movement is slower, by the amount of this relative movement, than the forward speed of the machine.

To increase the speed of forward movement of the application device, when returning the same to its forward position, the transmission ratio of the drive may be adjusted for an increased chain speed during the forward movement of the application device. Another possibility for increasing the speed with which the application device is moved into its forward position is to provide two endless chains with different relative speeds on the marking machine. When applying the marking material, i.e., during the rearward movement of the application device, the latter is coupled with the chain having the lower relative speed, while during its forward movement for return thereof to its forward position, the application device is coupled with the chain having the higher relative speed.

The desired length for the traffic line is controlled by a longitudinal control on the machine which also controls the opening and closing of the application device. When the desired strip or line length is obtained, the application device is closed. At the same time the application device is uncoupled from the lower chain strain and coupled to the upper chain strand, whereby the applicator device travels with a speed, which is higher than the movement speed of the machine, into its initial forward position. Then, the application device is again uncoupled from the upper chain strand and remains in a stand-by position until the beginning of another application operation for the following traffic line.

Thus, while only one embodiment of the present invention has been shown and described, it will be obvious that many changes and modifications may be made thereunto, without departing from the spirit and scope of the invention.

What is claimed is:

1. In a method for making marking strips and marking interruptions on a roadway so as to produce a traffic line composed of discrete, spaced-apart segments with a device comprising a marking machine and an activatable and deactivatable application means for applying marking material to the roadway displaceably mounted on the marking machine for movement between a forward and rearward position thereon, the improvement comprising the steps of:

moving said marking machine at a forward speed over the roadway in a driving direction;

alternately activating and deactivating said application means so as to produce a traffic line on said roadway composed of discrete, spaced-apart segments; and displaceably moving said application means between said forward and rearward positions thereof such that said application means is moving in the forward direction relative to the ground, while moving rearward relative to said marking machine, so as to spray said marking strip onto the ground during activation thereof.

* * * * *